US005862942A

United States Patent [19]

Yuyama et al.

[11] Patent Number: 5,862,942

[45] Date of Patent: Jan. 26, 1999

[54] AMPULE DISPENSER

[75] Inventors: Shoji Yuyama; Hiroyasu Hamada, both of Toyonaka, Japan

[73] Assignee: Kabushiki Kaisha Yuyama Seisakusho, Toyonaka, Japan

[21] Appl. No.: 881,271

[22] Filed: Jun. 24, 1997

[51] Int. Cl.[6] ..... G07F 11/66

[52] U.S. Cl. ..... 221/25; 221/30

[58] Field of Search ..... 221/25, 26, 30, 221/32, 103, 208, 210

[56] References Cited

U.S. PATENT DOCUMENTS 958,237 5/1910 Downey ..... 221/25

3,984,030 10/1976 Morini ..... 221/30

5,332,096 7/1994 Battaglia ..... 221/30

*Primary Examiner*—Kenneth Noland

*Attorney, Agent, or Firm*—Wenderoth, Lind & Ponack, L.L.P.

[57] ABSTRACT

A plastic ampule dispenser for dispensing plastic ampules supplied in the form of strips of ampules connected together. The plastic ampule dispenser has an inclined guide plate for sliding a plurality of strips of plastic ampules, each strip being formed with cutlines between the adjacent plastic ampules, a plastic ampule stopper for stopping the plastic ampule at one end of the strip when the strip slides on and along the guide plate, and a separating device for separating the plastic ampule stopped at the head of the strip from the adjacent plastic ampule along the cutline therebetween.

22 Claims, 10 Drawing Sheets

AMPULE DISPENSER

BACKGROUND OF THE INVENTION

This invention relates to an ampule dispenser for separating series-connected plastic ampules from one another and dispensing them one after another.

Ampule dispensers capable of dispensing a required number of ampules one by one are disclosed in unexamined Japanese utility model publication 5-86873 and examined Japanese utility model publication 6-14753.

Some of these ampule dispensers dispense glass ampules while others dispense plastic ampules.

Referring to FIGS. 12 and 13, a plastic ampule comprises a body a and tab d having a cap c and integrally connected with the body a through a separation line b. The tab d is separable from the body a by twisting it. By removing the tab d, the top of the body a is opened.

A plurality of such plastic ampules A1 are arranged side by side and series-connected in a strip. Cut-apart lines or thin portions B are provided between the adjacent plastic ampules A1.

In order to dispense ampules in series-connected plastic ampule strips A0 as shown in FIG. 12 from an ampule dispenser, plastic ampules A1 have to be separated from one another along the lines B.

Heretofore, ampules were separated manually, so that such separation of ampules were very troublesome.

An object of this invention is to provide an ampule dispenser which can separate series-connected ampules with a high degree of efficiency.

SUMMARY OF THE INVENTION

According to this invention, there is provided a plastic ampule dispenser comprising an inclined guide plate for sliding a plurality of strips of plastic ampules arranged side by side and series-connected together with a plastic ampule at one end of the strip at the head. Each strip is formed with cutlines between the adjacent plastic ampules. A plastic ampule stopper is provided for stopping the plastic ampule at one end of the strip when the strip slides on and along the guide plate. Also, a separating means is provided for separating the plastic ampule stopped at the head of the strip from the adjacent plastic ampule along the cutline therebetween.

The separating means may comprise a groove formed in the plastic ampule stopper and capable of receiving one plastic ampule at a time, and a rotary means for rotating the ampule stopper about an axis extending in the direction in which the strip slides on the guide plate, or a cutter moved along each of the cutlines. The separating means comprising rotary means for rotating the ampule stopper to separate ampules by twisting. In this arrangement, a presser is provided to prevent the second plastic ampule from floating when the ampule at the head is separated by twisting.

In order to separate ampules more efficiently, the ampule dispenser may further comprises a plastic ampule housing provided over the guide plate and capable of storing a plurality of the strips of plastic ampules one on another, and a discharge means for discharging the strips of plastic ampules in the housing one by one from the bottom of the housing onto the guide plate.

For the same purpose, the ampule dispenser may be provided with a plastic ampule housing provided over the guide plate and capable of storing a plurality of the strips of plastic ampules one on another, the housing having a discharge passage on one side, and a pushing means for pushing the lowest one of the plurality of strips of plastic ampules in the housing into the discharge passage.

Every time the ampule at the head of a strip of series-connected plastic ampules sliding along the inclined guide plate is received in the stopper member, the ampule at the head of the strip is separated by the separating means.

Other features and objects of the present invention will become apparent from the following description made with reference to the accompanying drawings, in which:

DETAILED DESCRIPTION OF THE PREFERRED EMBODIMENT

The embodiments of the present invention will now be described with reference to the accompanying drawings.

Figure 12:
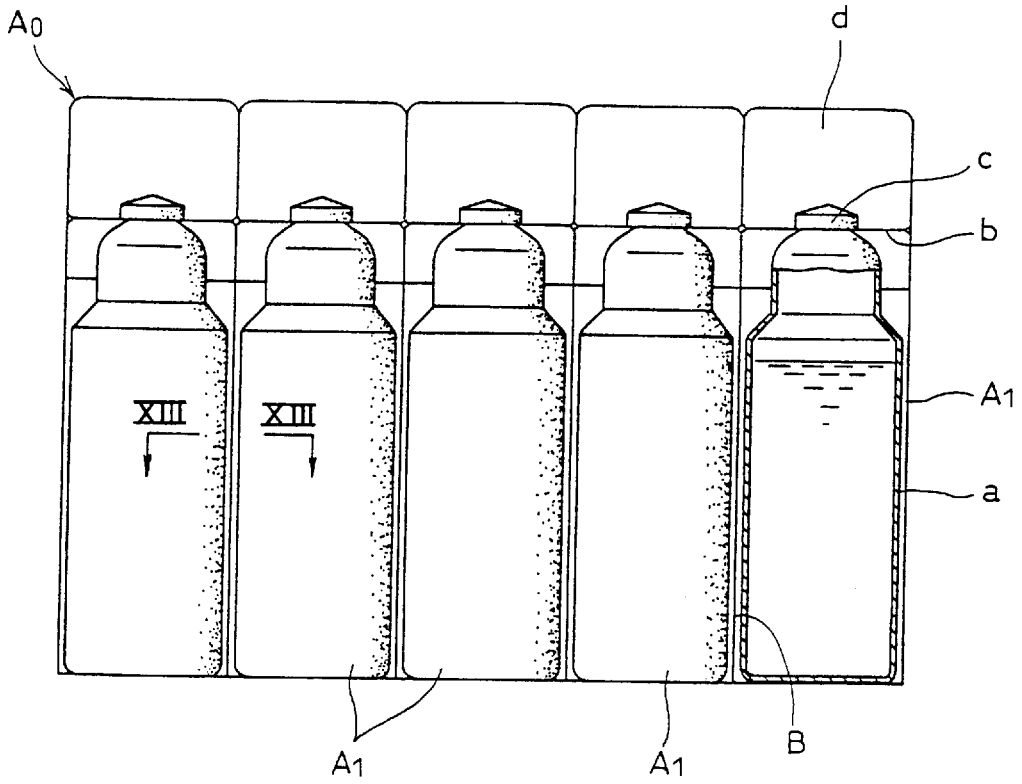
FIG. 12 is a partially cutaway front view of a strip of series-connected plastic ampules.
Figure 13:
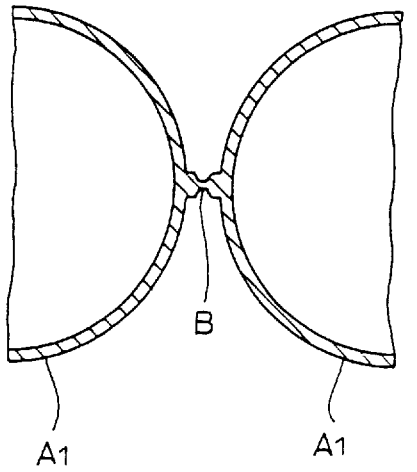
FIG. 13 is a sectional view taken along line XIII—XIII of FIG. 9.

FIGS. 1–5 shows a first embodiment. As shown, the ampule dispenser of the first embodiment has a box member 1 comprising an inclined guide plate 2, and an ampule housing 3 in which are stacked a plurality of strips A0 of series-connected plastic ampules such as those shown in FIG. 12.

The ampule strips A0 in the ampule housing 3 are taken out one by one onto the guide plate 2 by an ampule ejector 10 provided at the bottom of the ampule housing 3.

Figure 2:
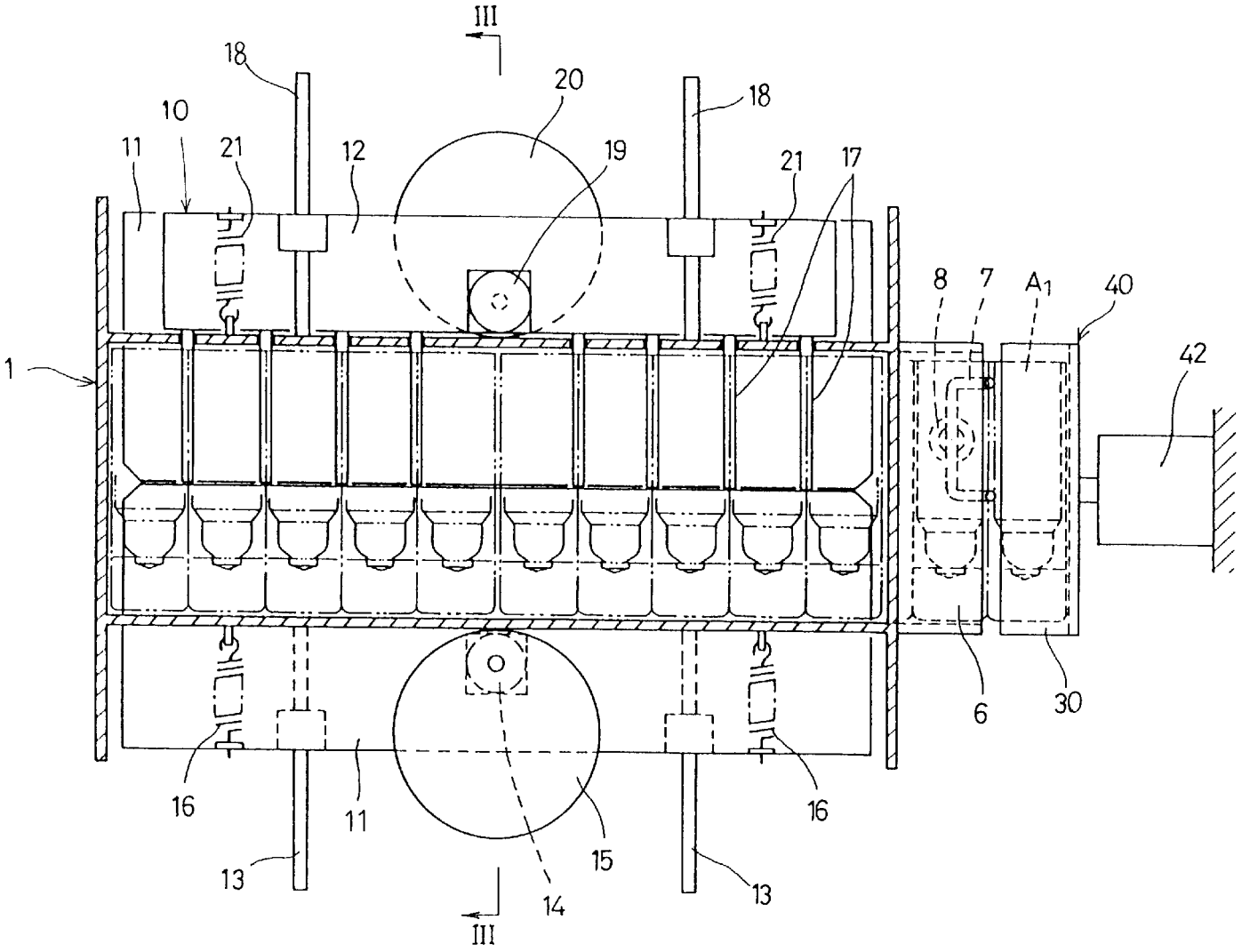
FIG. 2 is a sectional view taken along line II—II of FIG. 1.
Figure 3:
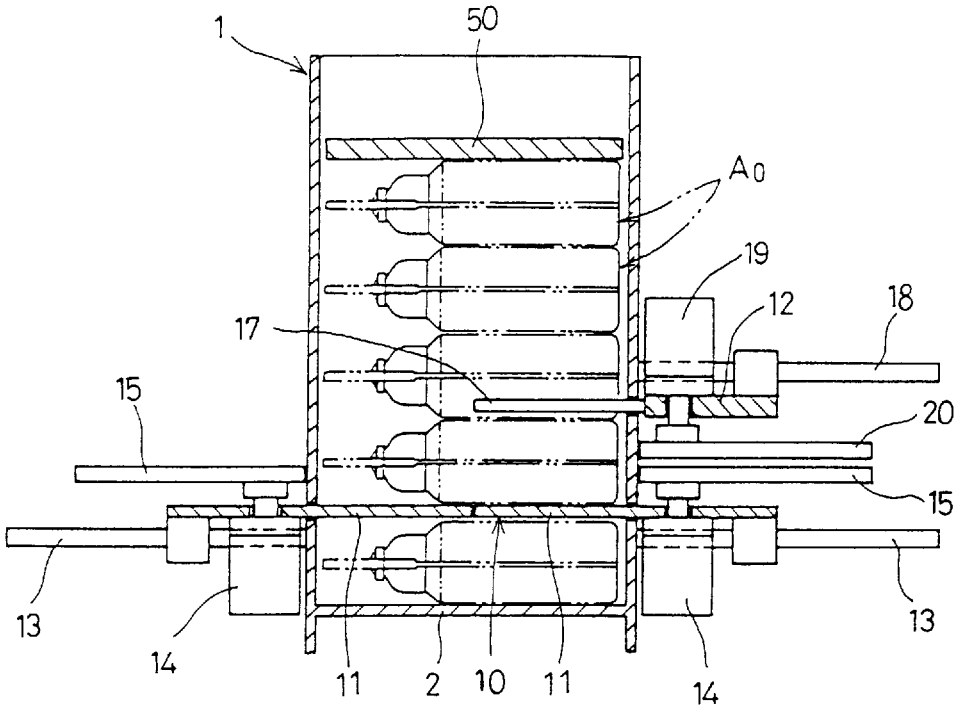
FIG. 3 is a sectional view taken along line III—III of FIG. 2.

As shown in FIGS. 2 and 3, the ejector 10 includes first stoppers 11 for supporting the lowermost one of the plastic ampule strips A0 in the ampule housing 3, and a second stopper 12 for supporting the second lowest one of the plastic ampule strips A0.

The first stoppers 11 are plate members slidably supported on guide shafts 13 provided on one side of the stocker. The first stoppers 11 each carry a motor 14 having a cam 15 on its rotary shaft. Springs 16 bias the first stoppers 11 to press the cams 15 against both sides of the box member 1. By activating the motors 14, the cams 15 rotate, moving the first stoppers 11 into and out of the ampule housing 3. When moved into the housing 3, the first stoppers 11 support the plastic ampule strips A0.

The second stopper 12 has comb-like teeth 17 at its tip which can support both sides of each plastic ampule A1 of the strip A0 from its bottom. The second stopper 12 is supported so as to be slidable along guide shafts 18 provided on one side of the box member 1.

The second stopper 12 carries a motor 19 having a cam 20 mounted on its rotary shaft. Springs 21 bias the second stopper 12 to press the cam 20 against one side of the box member 1. By activating the motor 19, the cam 20 rotates, moving the second stopper 12 into and out of the ampule housing 3. When moved into the housing 3, the second stopper supports the second lowest plastic ampule strip A0.

The first stoppers 11 and the second stopper 12 are alternately moved into and out of the housing 3. When the first stoppers 11 move out of the housing, the lowest plastic ampule strip A0 is discharged onto the guide plate 2.

Figure 1:
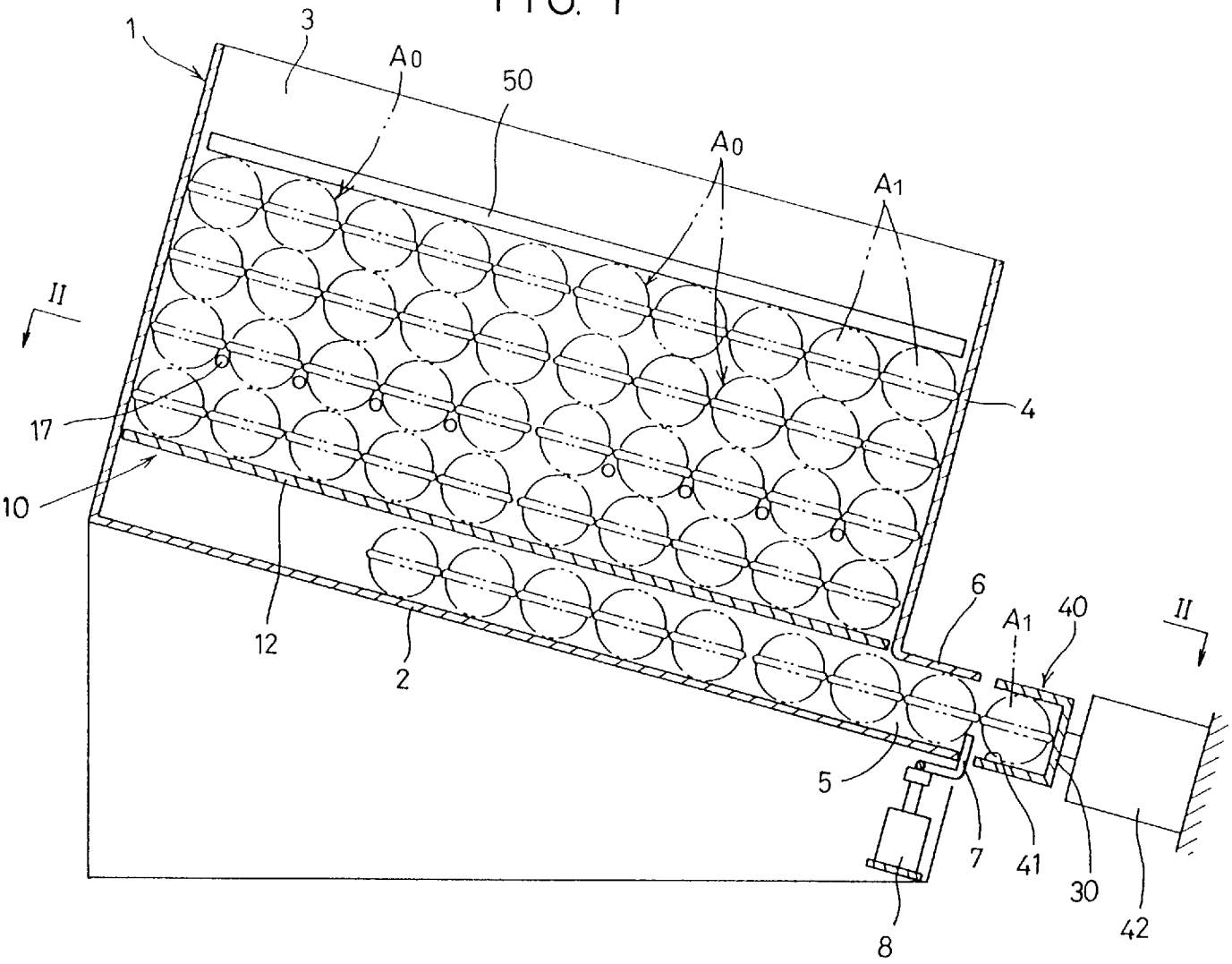
FIG. 1 is a vertical sectional front view of a first embodiment of an ampule dispenser according to the present invention.

As shown in FIG. 1, a presser 6 is provided at the bottom of a front plate 4 of the ampule housing 3. A discharge port 5 is defined between the presser 6 and the guide plate 2. A gate stopper 7 is provided in the discharge port 5. The gate stopper 7 is raised and lowered by a cylinder 8, and stops a plastic ampule strip A0 when raised.

In front of the discharge port 5, an ampule receiver 30 is provided to stop each plastic ampule strip A0 that has slid down the guide plate 2 by abutting the ampule A1 at the head of the strip when this ampule comes out of the discharge port 5. In this state, the ampule A1 at the head of the strip is separated from the strip by a separating unit 40.

The separating unit 40 comprises the ampule receiver 30, which has a recess 41 in which one ampule A1 can be received, and a motor 42 for turning the receiver 30. By turning the receiver 30 with the ampule A1 at the head of each strip received in the recess 41, the ampule A1 is twisted and separated from the strip.

Numeral 50 in FIG. 1 indicates a presser plate for pressing plastic ampule strips A0 stored in the ampule housing 3.

When the lowermost one of a plurality of plastic ampule strips A0 stored in the ampule housing 3 is discharged onto the guide plate 2, this strip A0 slides down the top surface of the guide plate 2.

In this state, the gate stopper 7 is lowered, so that the plastic ampule A1 at the head of the strip A0 is discharged through the discharge port 5.

When the plastic ampule A1 at the head of the strip is received in the recess 41 of the ampule receiver 30, the gate stopper 7 rises and abuts the second plastic ampule A1 from front.

When the gate stopper 7 rises and stops, the motor 42 is activated to rotate the ampule receiver 30. The plastic ampule A1 at the head is thus twisted and separated from the next ampule along the cut-apart line B between these two plastic ampules A1.

Since the ampule receiver 30 is inclined in this state, the seperated front plastic ampule A1 drops from the recess 41.

The ampule receiver 30 then turns 360° and stops when the recess 41 faces the discharge port 5 again. Since the plastic ampule A1 at the head of the ampule plastic strip A0 is held in the discharge port 5 by the gate stopper 7, the ampule receiver 30 can rotate freely without being hindered by the ampule A1.

When the ampule receiver rotates 360° and stops, the gate stopper 7 is lowered to let the plastic ampule strip A0 slide down until the ampule A1 at the head is received in the recess 41 of the ampule receiver 30. The gate stopper 7 then rises again. The above cycle is repeated to separate plastic ampules A1 one after another.

Figure 4:
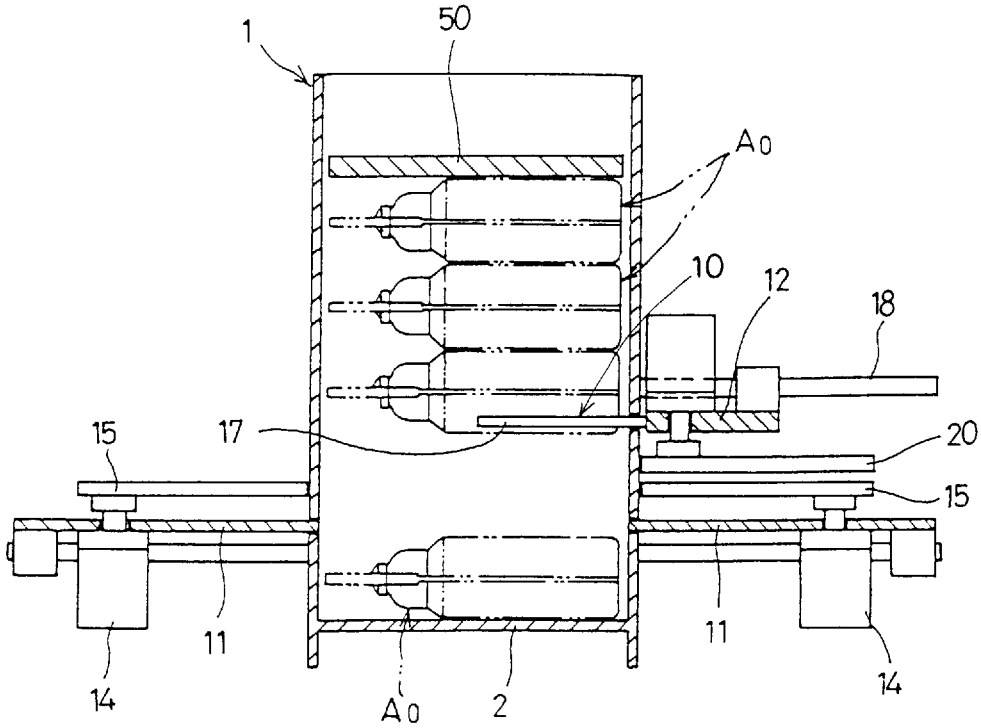
FIG. 4 is a similar view to FIG. 3 showing an operational state.
Figure 5:
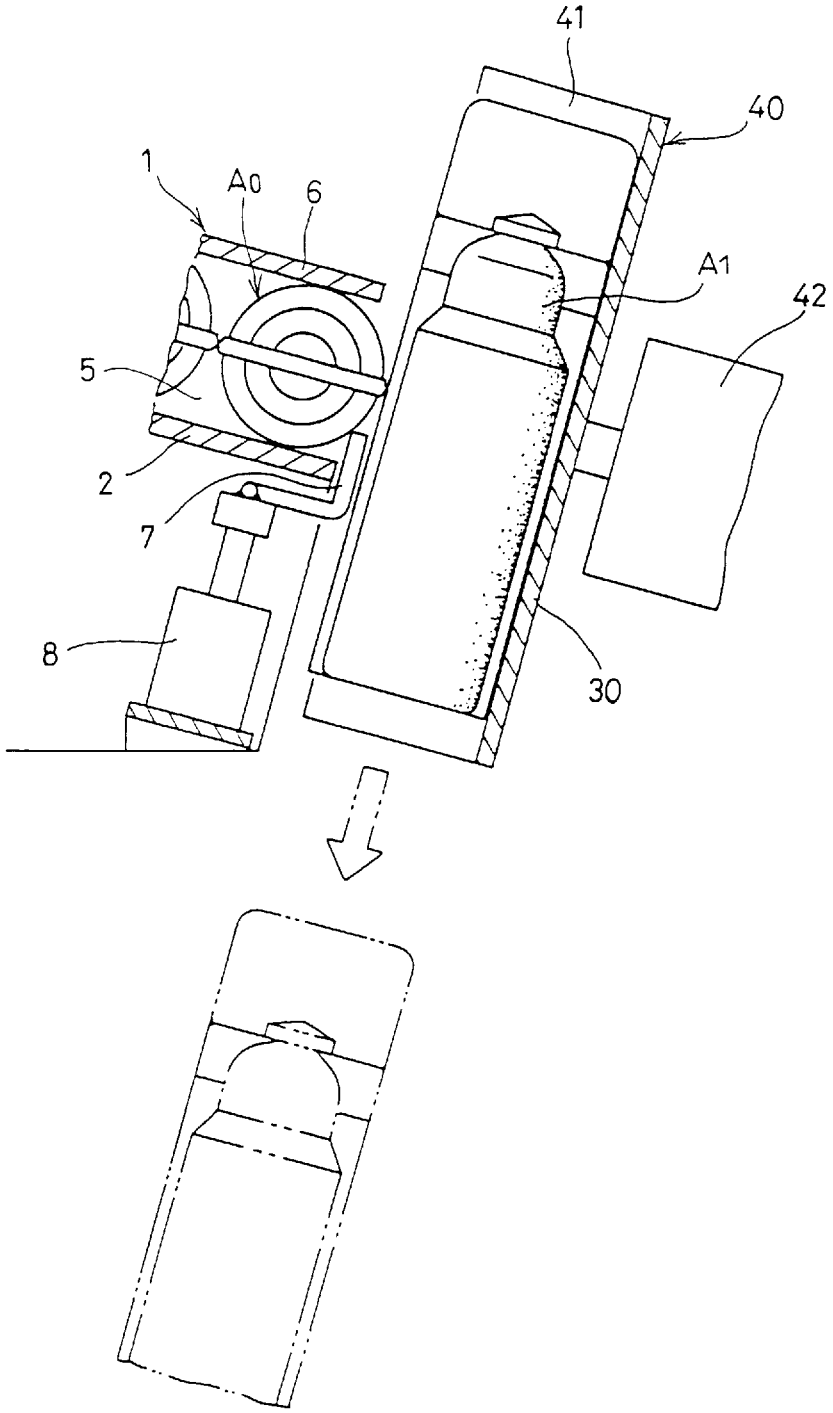
FIG. 5 is a view showing how a plastic ampule is separated from a strip of plastic ampules.

When all of the plastic ampules have been separated and removed from the guide plate, the second stopper 12 of the ejector 10, shown in FIG. 3, is moved into the ampule housing 3 to support the second lowest ampule strip A0, and then the first stoppers 11 are moved out of the housing, as shown in FIG. 4, to drop the lowest one of the plastic ampule strips A0 in the ampule housing 3 onto the guide plate 2.

Figure 6:
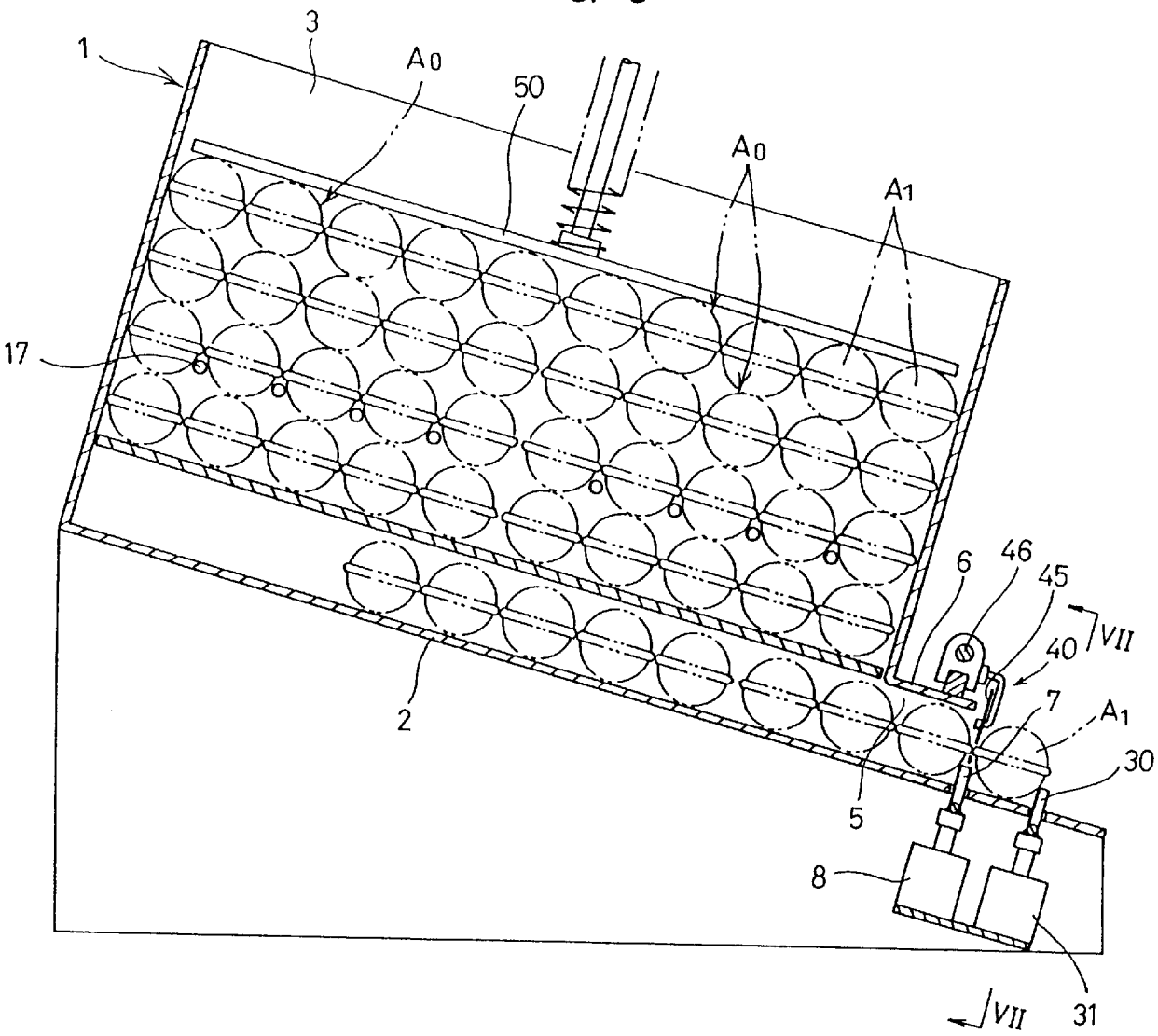
FIG. 6 is a vertical sectional front view of a second embodiment of an ampule dispenser according to this invention.
Figure 7:
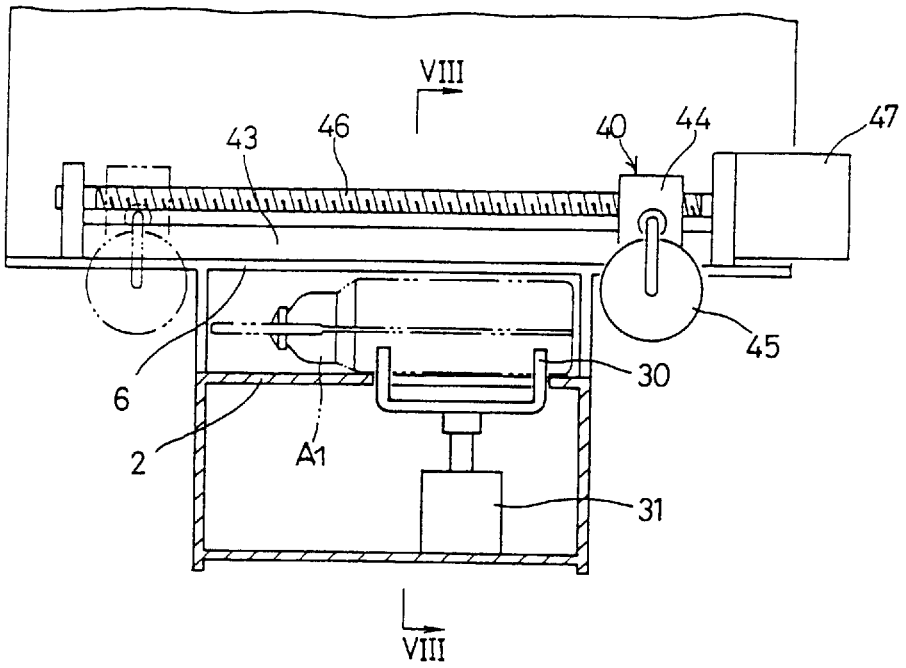
FIG. 7 is a sectional view taken along line VII—VII of FIG. 6.
Figure 8:
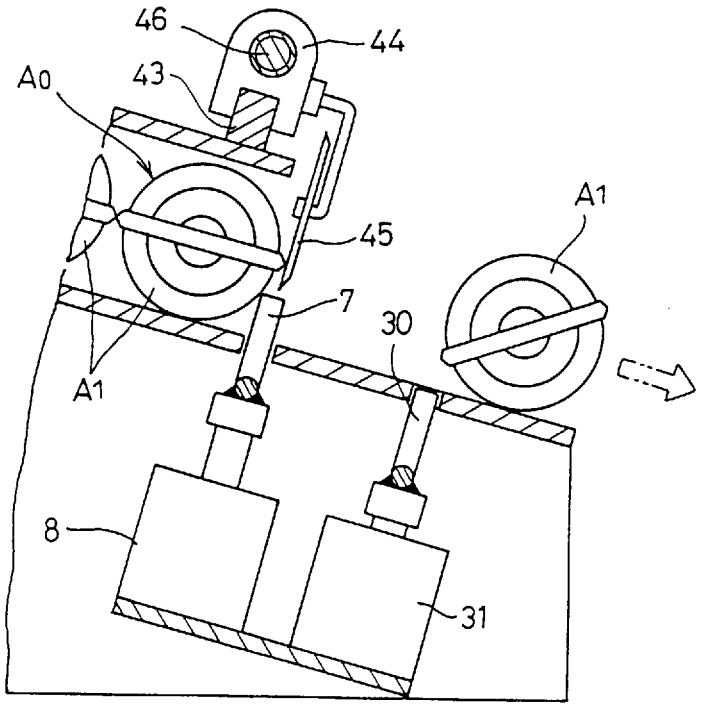
FIG. 8 is a sectional view taken along line VIII—VIII of FIG. 7.

FIGS. 6–8 show the second embodiment of this invention. In this embodiment, the ampule receiver 30 provided in front of the gate stopper 7 is raised and lowered by a cylinder 31. When raised, it stops the plastic ampule A1 at the head of the plastic ampule strip A0 on the guide plate.

The separating unit 40 comprises a guide rail 43 mounted above the presser 7, a slide member 44 slidably mounted on the guide rail 43, a circular cutter 45 rotatably mounted on the slide member 44, a threaded shaft 46 extending parallel to the guide rail 43 and threadedly engaging the slide member 44, and a motor 47 for turning the threaded shaft 46 to move the cutter 45 along the guide rail 43 to cut off the front ampule A1 from the next ampule A1 along the cutline B.

This embodiment is otherwise structurally identical to the embodiment of FIGS. 1–5. Identical elements are therefore denoted by identical numerals and their description is omitted.

In this embodiment, every time the plastic ampule A1 at the head of each plastic ampule strip A0 is stopped by the ampule receiver 30, the cutter 45 is moved to cut off this ampule A1.

Figure 9:
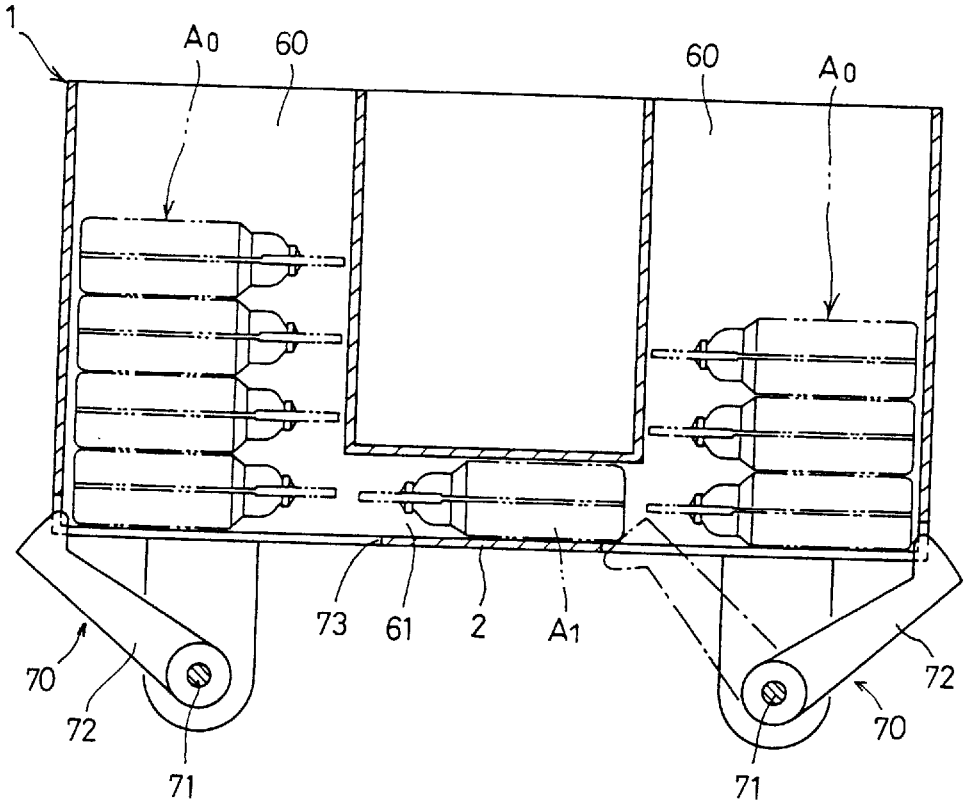
FIG. 9 is a vertical sectional side view of a third embodiment.
Figure 10:
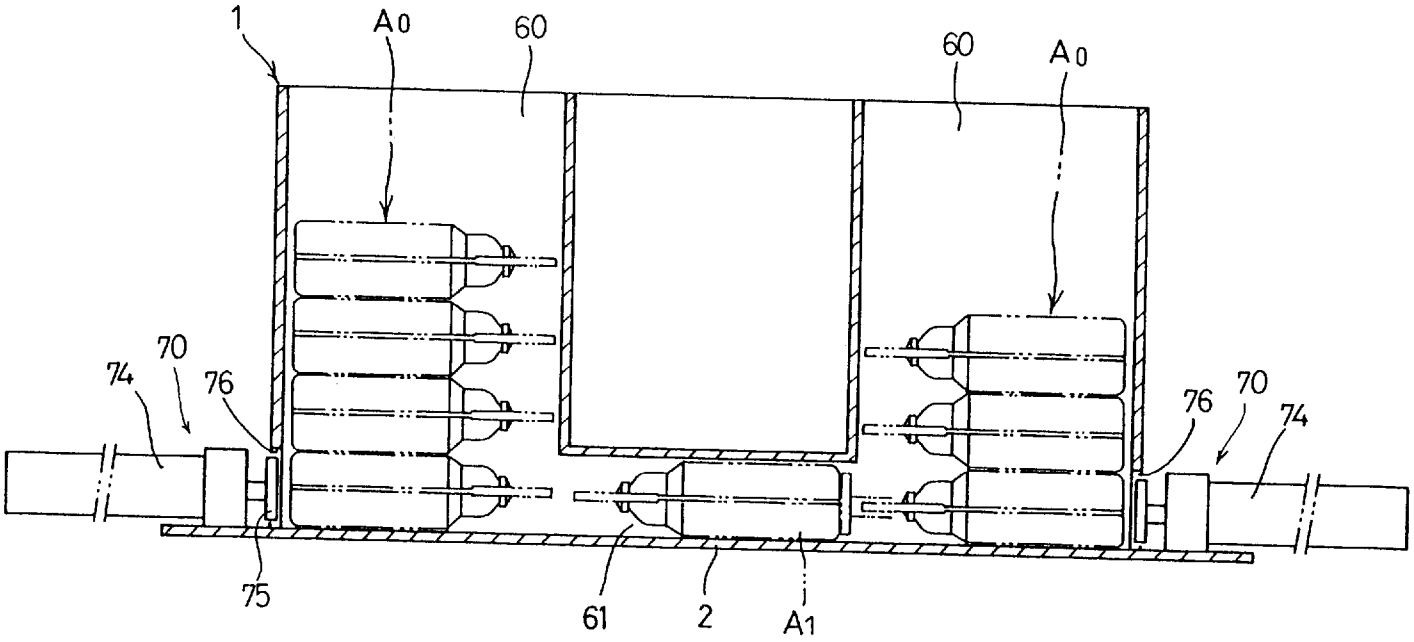
FIG. 10 is a sectional view of a different pusher.
Figure 11:
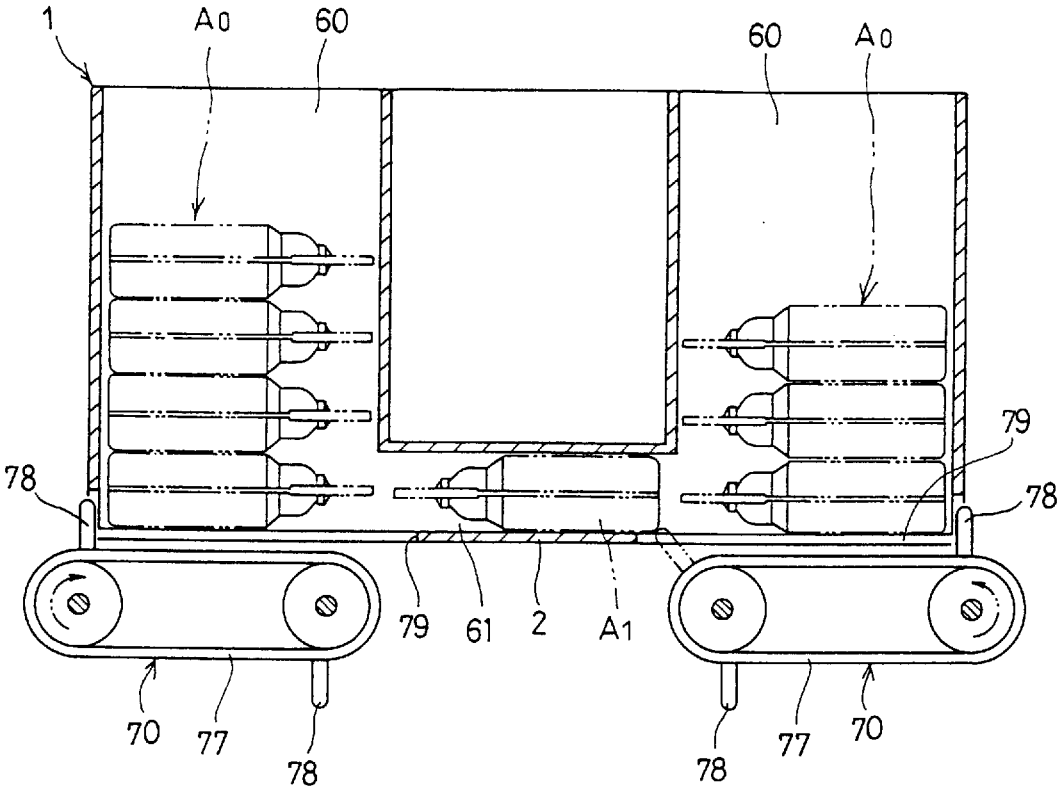
FIG. 11 is a sectional view of a still different type of pusher.

FIGS. 9–11 show a third embodiment of this invention. In this embodiment, a pair of ampule housings 60 are provided on both sides of an inclined guide plate 2 provided at the bottom of a box member 1. A plurality of plastic ampule strips A0 are stored in each housing 60. The ampule strips A0 in the ampule housings 60 are pushed one by one from the bottom into a discharge passage 61 by pushers 70 provided under the respective housings 60.

Each pusher 70 shown in FIG. 9 comprises a rotary shaft 71 provided under the ampule housing 60, and an arm 72 mounted on the shaft 71 and having its free end movable in a cutout 73 formed in the guide plate 2. By rotating the rotary shaft 71, the arm 72 pivots, thus pushing the lowermost one of the plastic ampule strips A0 in the housing 60 into the discharge passage 61.

The pushers 70 shown in FIG. 10 comprise each a cylinder 74, and an end plate 75 moved by the cylinder 74 into and out of each ampule housing 60 through a window 76 formed in the lower part of the side wall of the housing 60 to push the lowest plastic ampule strip A0 into the discharge passage 61 when pushed into the housing.

The pushers 70 shown in FIG. 11 comprise each an endless belt 77 provided under each ampule housing 60, and a projection 78 provided on the belt 77 and movable along a cutout 79 formed in the guide plates 2. By moving the belt 77, the lowest plastic ampule strip A0 is pushed by the projection 78 into the discharge passage 61.

When one of any pair of the above pushers 70 is activated, the other pusher is deactivated so that plastic ampule strips A0 are pushed one at a time into the discharge passage 61.

Any plastic ampule strip A1 pushed into the discharge passage 61 slides down along the top surface of the guide plate 2, and the ampules A1 forming the strip are separated one after another from its leading end, in the same manner as in the embodiment of FIG. 1.

As described above, according to this invention, when a plastic ampule strip drops onto the inclined guide plate, it slides down the guide plate, and every time the ampule at the head of the strip is received by the ampule receiver, the ampule at the head is separated from the strip. It is thus possible to separate ampules forming the strip one by one with a high degree of efficiency.

Ampule strips stored in the ampule housing are dropped one by one from the bottom of the housing onto the guide plate, so that it is possible to separate ampules more efficiently.

What is claimed is:

1. A plastic ampule dispenser for dispensing plastic ampules, one at a time, from a strip of series-connected plastic ampules disposed in a side-by-side manner, the strip of plastic ampules being formed with cutlines separating the plastic ampules which are disposed adjacent to each other, said plastic ampule dispenser comprising:

an inclined guide plate for slidably receiving the strip of plastic ampules, said inclined guide plate having a first end and a second end which is disposed below said first end such that the strip of plastic ampules will slide on said inclined guide plate in a direction from said first end toward said second end;

a plastic ampule stopper, disposed at said second end of said guide plate, for stopping the plastic ampule at a leading end of the strip when the strip slides on and along said guide plate; and a separating unit, disposed adjacent said plastic ampule stopper, for separating the plastic ampule at the leading end of the strip from the remainder of the strip.

2. The plastic ampule dispenser as claimed in claim 1, wherein said separating unit comprises:

a plastic ampule receiver defining a recess for receiving one plastic ampule at a time; and a rotary mechanism for rotating said plastic ampule receiver about an axis extending in the direction in which said strip slides on said guide plate.

3. The plastic ampule dispenser as claimed in claim 1, wherein said separating unit comprises a cutter which is movable along each of the cutlines.

4. The plastic ampule dispenser as claimed in claim 1, further comprising:

an ampule housing provided over said guide plate and being capable of storing a plurality of the strips of plastic ampules; and a discharge means for discharging the strips of plastic ampules, one by one, from the bottom of said ampule housing onto said guide plate.

5. The plastic ampule dispenser as claimed in claim 4, wherein said discharge means comprises:

a first stopper movable into and out of said ampule housing, wherein said first stopper supports the lowermost one of the plurality of strips of plastic ampules stored in said ampule housing when said first stopper is moved into said ampule housing;

a second stopper movable into and out of said ampule housing, wherein said second stopper supports the second lowermost one of said plurality of strips of plastic ampules when said second stopper is moved into said ampule housing, wherein said first stopper and said second stopper move into and out of said ampule housing alternately so that one of said first and second stoppers is moved out of said ampule housing after the other of said first and second stoppers has been moved into said ampule housing and stopped.

6. The plastic ampule dispenser as claimed in claim 2, further comprising:

an ampule housing provided over said guide plate and being capable of storing a plurality of strips of plastic ampules; and a discharge means for discharging the strips of plastic ampules, one by one, from the bottom of said ampule housing onto said guide plate.

7. The plastic ampule dispenser as claimed in claim 6, wherein said discharge means comprises:

a first stopper movable into and out of said ampule housing, wherein said first stopper supports the lowermost one of the plurality of strips of plastic ampules stored in said ampule housing when said first stopper is moved into said ampule housing;

a second stopper movable into and out of said ampule housing, wherein said second stopper supports the second lowermost one of said plurality of strips of plastic ampules when said second stopper is moved into said ampule housing, wherein said first stopper and said second stopper move into and out of said ampule housing alternately so that one of said first and second stoppers is moved out of said ampule housing after the other of said first and second stoppers has been moved into said ampule housing and stopped.

8. The plastic ampule dispenser as claimed in claim 3, further comprising:

an ampule housing provided over said guide plate and being capable of storing a plurality of strips of plastic ampules; and a discharge means for discharging the strips of plastic ampules, one by one, from the bottom of said ampule housing onto said guide plate.

9. The plastic ampule dispenser as claimed in claim 8, wherein said discharge means comprises:

a first stopper movable into and out of said ampule housing, wherein said first stopper supports the lowermost one of the plurality of strips of plastic ampules stored in said ampule housing when said first stopper is moved into said ampule housing;

a second stopper movable into and out of said ampule housing, wherein said second stopper supports the second lowermost one of said plurality of strips of plastic ampules when said second stopper is moved into said ampule housing, wherein said first stopper and said second stopper move into and out of said ampule housing alternately so that one of said first and second stoppers is moved out of said ampule housing after the other of said first and second stoppers has been moved into said ampule housing and stopped.

10. The plastic ampule dispenser as claimed in claim 1, further comprising:

an ampule housing provided over said guide plate and being capable of storing a plurality of strips of plastic ampules, said ampule housing having a discharge passage on one side thereof; and a pushing means for pushing the lowermost one of the plurality of strips of plastic ampules, stored in said ampule housing, into said discharge passage.

11. The plastic ampule dispenser as claimed in claim 10, wherein said pushing means comprises an arm provided under said ampule housing, said arm having a tip portion for engaging and pushing one side of the lowermost one of said strips of plastic ampules stored in said ampule housing upon rotation of said arm in one direction.

12. The plastic ampule dispenser as claimed in claim 10, wherein said pushing means comprises a pusher which is reciprocated by a cylinder for pushing one side of the lowermost one of the plurality of strips of plastic ampules when pushed by said cylinder.

13. The plastic ampule dispenser as claimed in claim 10, wherein said pushing means comprises an endless belt having a projection connected thereto so that said projection moves together with said endless belt for pushing one side of the lowermost one of the plurality of plastic ampule strips in said ampule housing.

14. The plastic ampule dispenser as claimed in claim 2, further comprising:

a plastic ampule housing provided over said guide plate and being capable of storing a plurality of strips of plastic ampules, said plastic ampule housing having a discharge passage on one side thereof; and a pushing means for pushing the lowermost one of the plurality of strips of plastic ampules, stored in said ampule housing, into said discharge passage.

15. The plastic ampule dispenser as claimed in claim 14, wherein said pushing means comprises an arm provided under said ampule housing, said arm having a tip portion for engaging and pushing one side of the lowermost one of the strips of plastic ampules stored in said ampule housing upon rotation of said arm in one direction.

16. The plastic ampule dispenser as claimed in claim 14, wherein said pushing means comprises a pusher which is reciprocated by a cylinder for pushing one side of the lowermost one of the plurality of strips of plastic ampules when pushed by said cylinder.

17. The plastic ampule dispenser as claimed in claim 14, wherein said pushing means comprises an endless belt having a projection connected thereto so that said projection moves together with said endless belt for pushing one side of the lowermost one of the plurality of plastic ampule strips stored in said ampule housing.

18. The plastic ampule dispenser as claimed in claim 3, further comprising:

an ampule housing provided over said guide plate and being capable of storing a plurality of strips of plastic ampules, said ampule housing having a discharge passage on one side thereof; and a pushing means for pushing the lowermost one of the plurality of strips of plastic ampules, stored in said ampule housing, into said discharge passage.

19. The plastic ampule dispenser as claimed in claim 18, wherein said pushing means comprises an arm provided under said ampule housing, said arm having a tip portion for engaging and pushing one side of the lowermost one of the strips of plastic ampules stored in said ampule housing upon rotation of said arm in one direction.

20. The plastic ampule dispenser as claimed in claim 18, wherein said pushing means comprises a pusher which is reciprocated by a cylinder for pushing one side of the lowermost one of the plurality of strips of plastic ampules when pushed by said cylinder.

21. The plastic ampule dispenser as claimed in claim 18, wherein said pushing means comprises an endless belt having a projection connected thereto so that said projection moves together with said endless belt for pushing one side of the lowermost one of the plurality of plastic ampule strips in said ampule housing.

22. A plastic ampule dispenser for dispensing plastic ampules, one at a time, from a strip of series-connected plastic ampules disposed in a side-by-side manner, the strip of plastic ampules being formed with a cut lines between the plastic ampules which are disposed adjacent to each other, said plastic ampule dispenser comprising:

a guide plate for slidably receiving a strip of plastic ampules, said guide plate having a first end and a second end;

a plastic ampule stopper, disposed at said second end of said guide plate, for stopping the plastic ampule at a leading end of the strip when the strip slides on and along said guide plate; and a separating unit, disposed adjacent said plastic ampule stopper, for separating the plastic ampule at the leading end of the strip from the plastic ampules remaining on the strip, wherein said separating unit comprises:

a plastic ampule receiver defining a recess for receiving one plastic ampule at a time; and a rotary mechanism for rotating said plastic ampule receiver about an axis extending in a direction in which said strip slides on said guide plate.

* * * * *